US007694743B1

(12) United States Patent
Arning

(10) Patent No.: US 7,694,743 B1
(45) Date of Patent: Apr. 13, 2010

(54) ROV-DEPLOYABLE SUBSEA WELLHEAD GAS HYDRATE DIVERTER

(76) Inventor: Michael Dean Arning, 3118 Fm 528, Suite 195, Webster, TX (US) 77598

( * ) Notice: Subject to any disclaimer, the term of this patent is extended or adjusted under 35 U.S.C. 154(b) by 178 days.

(21) Appl. No.: 11/403,519

(22) Filed: Apr. 12, 2006

Related U.S. Application Data

(60) Provisional application No. 60/670,434, filed on Apr. 12, 2005.

(51) Int. Cl.
*E21B 29/12* (2006.01)

(52) U.S. Cl. ..... 166/368; 166/356; 277/579; 277/930

(58) Field of Classification Search ..... 166/368, 166/356; 277/579, 930
See application file for complete search history.

(56) References Cited

U.S. PATENT DOCUMENTS

| | | | | | |
|---|---|---|---|---|---|
| 2,665,929 | A * | 1/1954 | Sawyer | 277/425 |
| 2,820,653 | A * | 1/1958 | Yokel | 277/366 |
| 2,824,759 | A * | 2/1958 | Tracy | 277/399 |
| 2,911,047 | A * | 11/1959 | Henderson | 166/61 |
| 3,038,732 | A * | 6/1962 | Scott et al. | 277/605 |
| 3,063,500 | A * | 11/1962 | Logan | 166/351 |
| 3,211,223 | A * | 10/1965 | Hoch | 166/356 |
| 3,512,583 | A * | 5/1970 | James | 166/356 |
| 3,552,903 | A * | 1/1971 | Townsend, Jr. | 166/356 |
| 3,602,301 | A * | 8/1971 | James | 166/338 |
| 3,661,204 | A * | 5/1972 | Blanding et al. | 166/356 |
| 3,666,013 | A * | 5/1972 | Saadeh | 166/241.1 |
| 3,908,763 | A * | 9/1975 | Chapman | 166/302 |
| 3,953,982 | A * | 5/1976 | Pennock | 405/168.1 |
| 4,252,328 | A * | 2/1981 | Raj et al. | 277/302 |
| 4,258,794 | A * | 3/1981 | Sizer et al. | 166/356 |
| 4,397,586 | A * | 8/1983 | Weiss | 405/217 |
| 4,456,071 | A * | 6/1984 | Milgram | 166/356 |
| 4,558,744 | A * | 12/1985 | Gibb | 166/335 |
| 4,658,904 | A * | 4/1987 | Doremus et al. | 166/336 |
| 4,784,527 | A * | 11/1988 | Hunter et al. | 405/207 |
| 4,919,210 | A * | 4/1990 | Schaefer, Jr. | 166/356 |
| 5,259,458 | A * | 11/1993 | Schaefer et al. | 166/335 |
| 5,310,286 | A * | 5/1994 | Gilbert et al. | 405/169 |
| 6,000,701 | A * | 12/1999 | Burgess | 277/412 |
| 6,179,053 | B1 * | 1/2001 | Dallas | 166/77.51 |
| 6,273,193 | B1 * | 8/2001 | Hermann et al. | 166/359 |
| 6,289,993 | B1 * | 9/2001 | Dallas | 166/386 |
| 6,520,261 | B1 * | 2/2003 | Janoff et al. | 166/350 |
| 6,530,430 | B2 * | 3/2003 | Reynolds | 166/346 |
| 6,708,766 | B2 * | 3/2004 | Clark | 166/368 |
| 6,889,770 | B2 * | 5/2005 | Qvam et al. | 166/356 |
| 6,932,351 | B1 * | 8/2005 | Mowll | 277/512 |
| 7,036,596 | B2 * | 5/2006 | Reid | 166/302 |
| 7,096,955 | B2 * | 8/2006 | Zhang et al. | 166/338 |
| 7,219,740 | B2 * | 5/2007 | Saucier | 166/366 |
| 7,234,523 | B2 * | 6/2007 | Reid | 166/302 |

* cited by examiner

*Primary Examiner*—Thomas A Beach
(74) *Attorney, Agent, or Firm*—Karen B. Tripp

(57) ABSTRACT

A ROV-deployable gas hydrate diverter comprising a body having a circular disc shape with a center hole, and a handle attached to and protruding from a surface of the body, wherein the handle is adapted to be grasped by the grasping arm of an ROV to facilitate installation of the gas hydrate diverter over a subsea wellhead.

7 Claims, 6 Drawing Sheets

ROV-DEPLOYABLE SUBSEA WELLHEAD GAS HYDRATE DIVERTER

CROSS-REFERENCE TO RELATED APPLICATION

This application claims priority to U.S. Provisional Patent Application Ser. No. 60/670,434 filed on Apr. 12, 2005.

BACKGROUND OF THE INVENTION

1. Field of the Invention

The present invention relates to an apparatus for diverting gas hydrates away from a subsea connector attached to a subsea wellhead. More particularly, the present invention provides a gas hydrate diverter adapted to be installed over a subsea wellhead using a remotely operated vehicle for the purpose of diverting gas hydrates away from a subsea connector attached to the wellhead.

2. Description of Relevant Art

Hydrates of hydrocarbon gases have long presented serious problems in the drilling of oil and gas wells, particularly in polar drilling and in wells drilled under very deep water in temperate or equatorial regions. Gas hydrates, also referred to as gas clathrates, are crystalline solid structures made up of an ice-like mixture of gas and water. In particular, the gas molecules are trapped within a cage of water molecules. Natural gas hydrates may contain a wide range of gas molecules including hydrocarbons, most commonly methane, as well as other gases such as nitrogen, oxygen, carbon dioxide, hydrogen sulfide, and inert gases. Due to cold temperatures and high pressures, these naturally occurring gas hydrates are trapped beneath the ocean floor in a frozen state. However during deep water drilling of hydrate-containing strata, the hydrate-containing strata surrounding a hole (i.e., borehole) being drilled is heated due to heat generated from the rotation of the drilling bit as well as from pumping surface temperature drilling fluids down the out the drill bit and through the drill pipe. The heat generated during the drilling process heats the surrounding hydrate-containing strata around the drill pipe, or conductor pipe, to a temperature above freezing which causes melting of the frozen hydrates and release of the gas hydrates in the liquid and gas phases which are then free to migrate up and through the ocean floor. The released gas hydrates in liquid and gas phases tend to migrate up via a path of least resistance and typically travel along the exterior of the drill pipe or conductor pipe due to the micro-fractures formed in the strata adjacent the pipe during drilling. After the gas hydrates travel along the exterior of the pipe and exit the ocean floor, the gas hydrates continue to migrate upwardly through the sea water near a conductor housing (or conductor pipe) protruding above the ocean floor, then pass a subsea wellhead positioned above the conductor housing, and then the migrating gas hydrates tend to collect and become trapped inside a subsea connector attached to an upper portion of the subsea wellhead. At cold ocean floor temperatures the gas hydrates freeze again while trapped within the subsea connector that is designed to be removably attached by latching mechanisms within the connector to an upper portion of the subsea wellhead. When the gas hydrates freeze while trapped within the subsea connector, the subsea connector gets frozen or stuck to the wellhead as the connector or connector latches cannot be shifted or unlatched due to the presence of the frozen gas hydrates trapped inside the connector.

To remove a subsea connector frozen to a subsea wellhead, typically a subsea remotely operated vehicle (ROV) is deployed from the drilling rig to perform the task of heating the connector by pumping warm water or ethanol on the connector for hours in order to get the frozen gas hydrates to thaw enough to unlatch the connector from the wellhead. This process is extremely time consuming and costly as it can take hours to days to get a connector to unlock. In addition, a frozen connector presents a dangerous condition for a drilling rig to be attached to the wellhead, via the frozen connector, without being able to disconnect from the wellhead at a moments notice. Such dangerous situations may arise for example during a storm, loss of dynamic positioning, or during an underwater blowout when a drilling rig can not move off location in an emergency situation because the drilling rig is effectively latched to the ocean floor due to the rig being tethered to the connector which is frozen to the subsea wellhead.

Currently a heavy metal hydrate diverter attached to the exterior of the conductor housing is used to deflect gas hydrates away from the subsea connector located above a subsea wellhead which is positioned atop the conductor housing. One problem with a conventional metal hydrate diverter is that the metal hydrate diverter does not effectively provide an adequate seal around the conductor housing that prevents gas hydrates from collecting at the subsea connector. Another disadvantage of the conventional metal hydrate diverter is that it is very heavy weighing in excess of 1000 pounds (e.g., 1400 lbs.) which requires the heavy metal diverter to be installed onto the conductor housing at the surface rendering the drilling rig idle for about an hour while this operation is completed. This requirement means that expensive rig time (e.g., $12,000 per hour) must be devoted to the installation of the heavy metal hydrate diverter onto the conductor housing and the subsequent placement of the conductor housing onto the ocean floor.

Thus an objective of the present invention is to provide a gas hydrate diverter that effectively diverts gas hydrates away from the subsea connector in order to prevent collection of these hydrates at the connector which subsequently freeze and render the connector unreleasably connected to a subsea wellhead. Another objective of the present invention is to provide gas hydrate diverter that can be installed subsea without requiring the use of a drilling rig. There is a great economic incentive to allow the drilling rig to carry on with other tasks while another means such as an ROV is used to deploy and install a gas hydrate diverter that effectively diverts gas hydrates away from the subsea connector.

SUMMARY

The subject matter of the present disclosure is generally directed to a gas hydrate diverter that effectively diverts gas hydrates away from a subsea connector. The gas hydrate diverter of the present invention is designed to be light weight yet strong such that the gas hydrate diverter may be installed subsea onto a subsea wellhead with the use of an ROV.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF PREFERRED EMBODIMENTS

Figure 1:
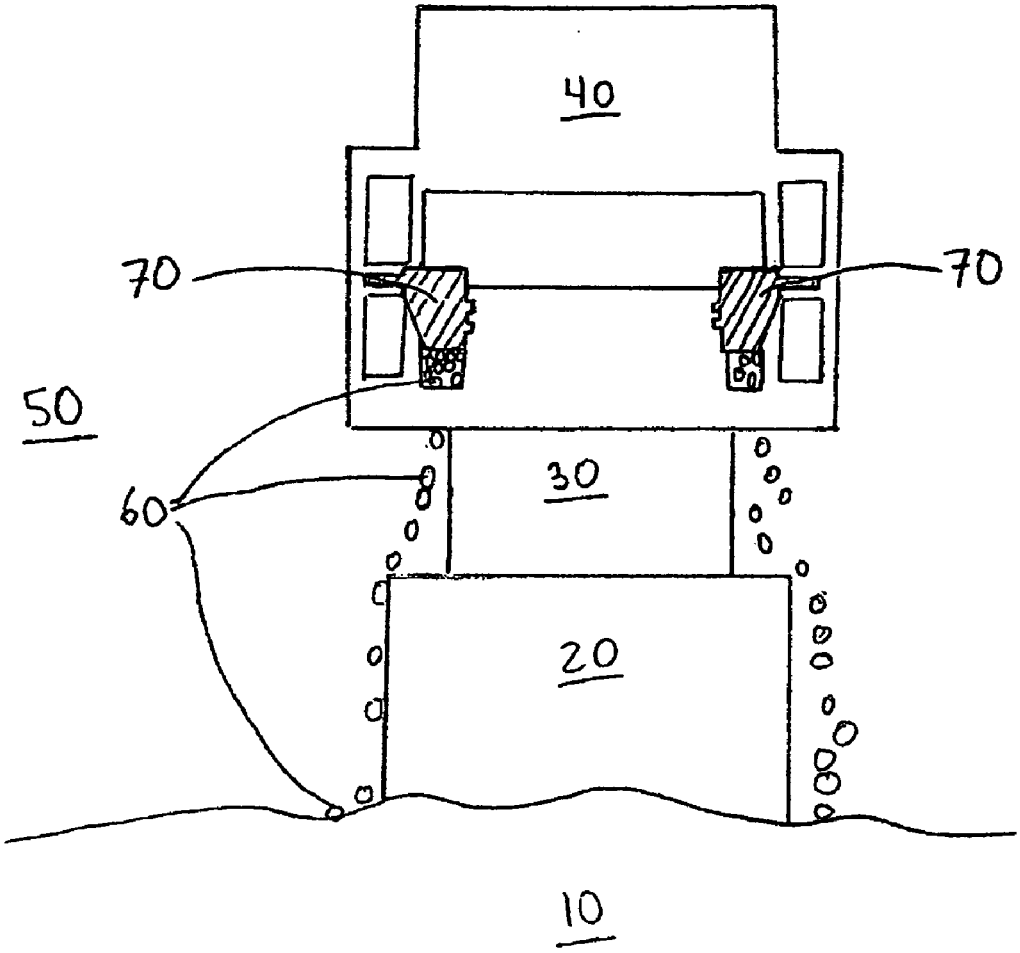
FIG. 1 PRIOR ART
FIG. 1 illustratively depicts a partial cross-sectional view of a typical subsea connector attached to a subsea wellhead.

The present disclosure is generally directed to a gas hydrate diverter adapted to be installed onto a subsea wellhead using an ROV. FIG. 1 depicts a cross-sectional view of a typical subsea connector 40 attached to a subsea wellhead 30. Subsea wellhead 30 sits atop a conductor housing 20 protruding above the ocean floor 10. Gas hydrates 60 that exit the ocean floor 10 near the conductor housing 20 migrate upwardly through the sea water 50 and tend to collect and become trapped inside a lower end of the subsea connector 40 wherein the subsea connector 40 attaches to an upper end of the subsea wellhead 30. As depicted in FIG. 1, the subsea connector 40 attaches to the subsea wellhead 30 by latches 70. At cold ocean water temperatures near the ocean floor 10, the gas hydrates 60 that have collected near one or both of the latches 70 can freeze and thereby render the latches frozen such that the latches 70 can not be unlatched to release the connector 40 from the wellhead 30. Such a condition is not only dangerous for a drilling rig that is unreleaseably connected to a wellhead, but also time consuming and costly for the drill rig to thaw the frozen gas hydrates 60 near the latches enough to unlatch the connector 40 from the wellhead 30.

Figure 2:
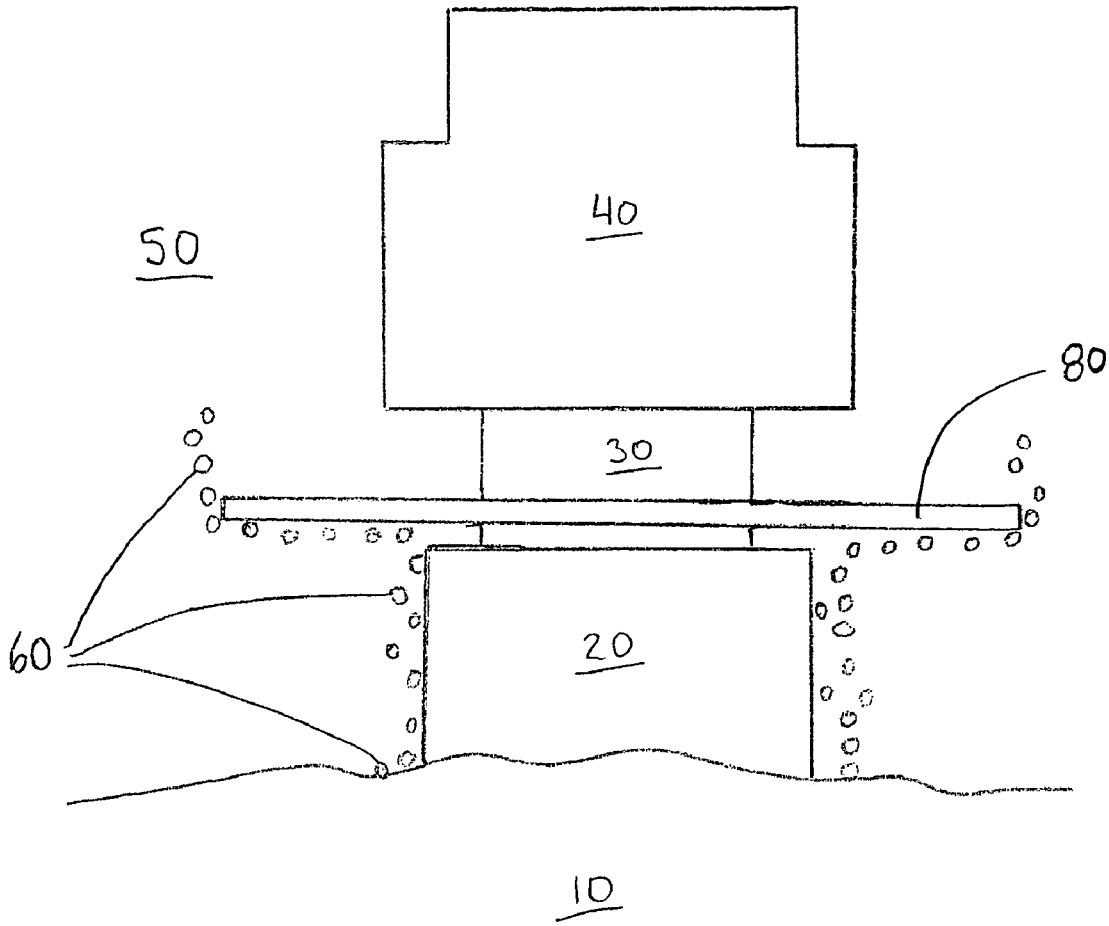
FIG. 2 illustratively depicts a perspective view of one embodiment of the gas hydrate diverter of the present invention.

FIG. 2 illustratively depicts one embodiment of a gas hydrate diverter 80 of the present invention attached to a subsea wellhead 30. An upper end of the subsea wellhead 30 is connected to a subsea connector 40 and a lower end of the subsea wellhead 30 is connected to a conductor housing 20 protruding above the ocean floor 10. The conductor housing 20 houses conductor pipe or drill pipe therein (not shown). The gas hydrate diverter 80 is positioned onto the subsea wellhead 30 to divert gas hydrates 60 away from a lower end of the subsea connector 40 such that gas hydrates 60 can not collect under and within the subsea connector 40 where the subsea connector 40 latches, or otherwise attaches, to the subsea wellhead 30 below.

Figure 3:
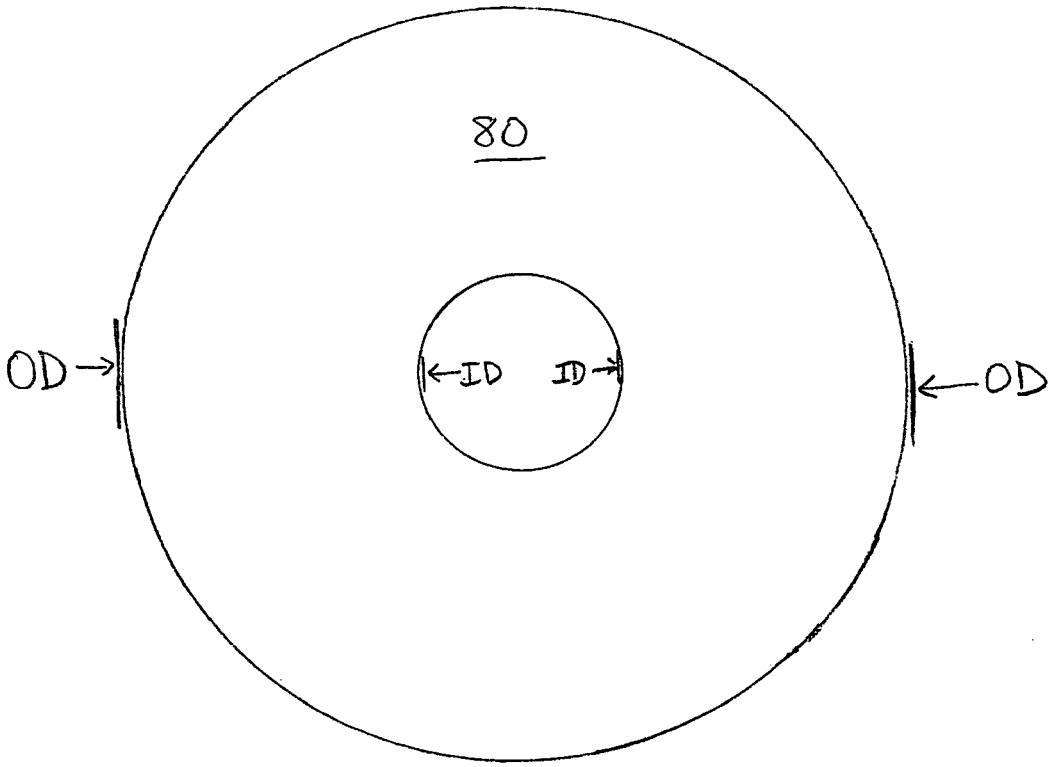
FIG. 3 is a top view of a gas hydrate diverter of the present invention.

FIG. 3 is a top view of a gas hydrate diverter 80 of the present invention. The gas hydrate diverter 80 generally has a circular disc shape with a center hole in the middle of the gas hydrate diverter 80 having sufficient size to fit over a subsea wellhead. The body of the gas hydrate diverter 80 may be made to essentially any size required to prevent gas hydrates from entering a lower end of the subsea gas connector positioned above as illustrated in FIG. 2. Preferably the outer diameter (OD) of the gas hydrate diverter 80 is in a range from about 40 inches to about 100 inches, and more preferably in a range from about 48 inches to about 72 inches. The inner diameter (ID) of the gas hydrate diverter 80 is sized to be about the same size at an outer diameter of the subsea wellhead upon which the gas hydrate diverter 80 will be installed onto. Suitable inner diameters of the gas hydrate diverter 80 may be in a range from about 20 inches to about 45 inches, and preferably about 27 inches or about 30 inches to fit snugly over the outer diameters (27" and 30") of current subsea wellheads.

Figure 4:
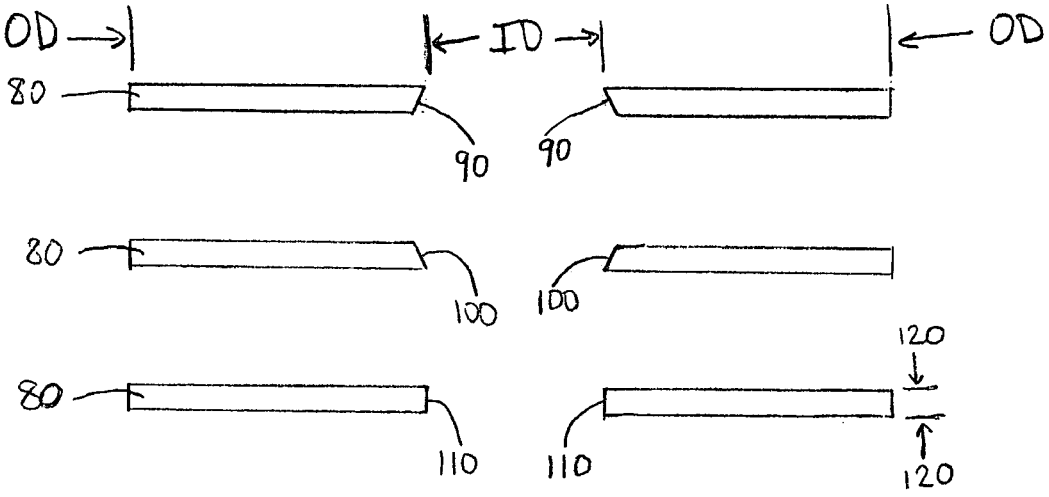
FIG. 4 depicts various cross-sectional views of the gas hydrate diverter in FIG. 3.

FIG. 4 illustrates various cross-sectional views of the gas hydrate diverter in FIG. 3. In order to ease installation and to ensure a tight fit of the gas hydrate diverter 80 over a subsea wellhead 30, the gas hydrate diverter 80 at its inner diameter is preferably tapered in order to accommodate any irregularities (i.e., surface features or imperfections) on the outside of the subsea wellhead. The ID of the gas hydrate diverter 80 may have an angle with either a taper up 90 or a taper down 100, as depicted in FIG. 4. A taper 90, 100 at the ID of the gas hydrate diverter 80 ensures a good seal between the ID of the gas hydrate diverter 80 and the outer diameter of the subsea wellhead upon which it is installed. It is to be understood that no taper 110 is required, as also depicted in FIG. 4. In addition the thickness 120 of the gas hydrate diverter 80 may be essentially any thickness, however the thickness is preferably limited to a thickness that provides the gas hydrate diverter 80 with enough rigidity to effectively divert gas hydrates away from the subsea connector as well as withstand the subsea environment encountered by the subsea wellhead and connector. Preferably, the thickness 120 of the gas hydrate diverter 80 is in a range from about 0.5 inches to about 5 inches. Also it should be noted that the thickness of the gas hydrate diverter 80 may vary radially such that a thickness near the ID of the gas hydrate diverter is different from a thickness near the OD of the gas hydrate diverter.

The gas hydrate diverter of the present invention may be made of essentially any light weight material such that the gas hydrate diverter is light enough to be installed over a subsea wellhead with a ROV. For the gas hydrate diverter to be ROV deployable, the gas hydrate diverter should have a weight when submersed in sea water of less about 450 pounds, and preferably less than about 400 pounds. In addition, the gas hydrate diverter is preferably made out of a material that is known to resist corrosion in a sea water environment. Suitable materials for fabricating the gas hydrate diverter include polymeric materials, elastomers (e.g. rubber), light metals, and combinations thereof. For example, preferable materials include various plastics such as polyethylene, Duron™ (e.g., PTFE), Delron®, urethanes, and light metals such as aluminum and pewter.

Figure 5:
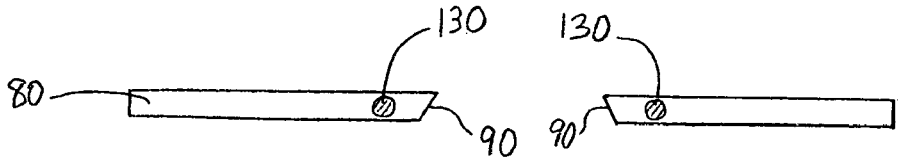
FIG. 5 illustratively depicts a cross-sectional view of a gas hydrate diverter of the present invention containing a reinforcement ring, according to another embodiment of the invention.
Figure 6:
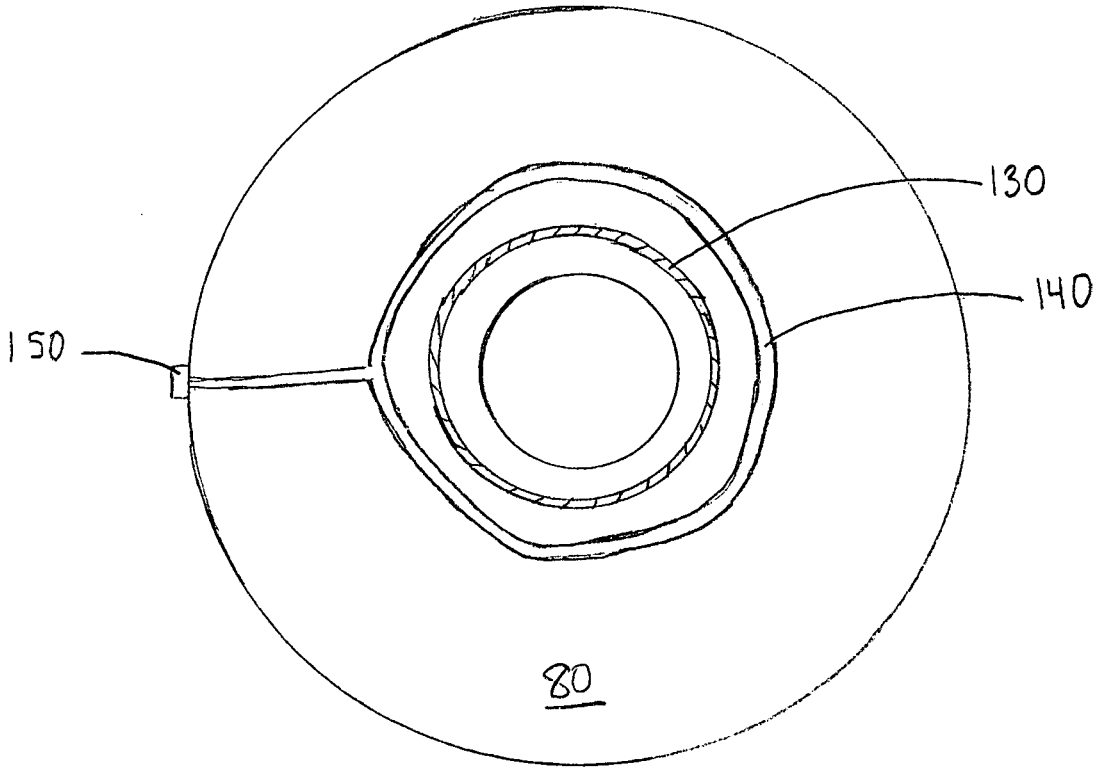
FIG. 6 is a top cross-sectional view of a gas hydrate diverter of the present invention equipped with tubing, according to another embodiment of the invention.

FIG. 5 is a cross-sectional view of another embodiment of the gas hydrate diverter of the present invention, wherein the gas hydrate diverter is made of a composite material. As depicted in FIGS. 5 and 6, the body of the gas hydrate diverter 80 is made of a plastic, such as Duron™ or Delron®, and contains a reinforcement ring 130 encapsulated within the body of the gas hydrate diverter 80 near its ID. The encapsulated reinforcement ring 130 imparts enhanced rigidity and stiffness near the ID of the gas hydrate diverter in order to further ensure an intimate contact (i.e., a seal) between the ID of the gas hydrate diverter and the subsea wellhead it is installed onto. The reinforcement ring 130 may be made of essentially any relatively hard material, such as a hard plastic or a metal. It should be noted that there may be a plurality of reinforcement rings encapsulated into the body of the gas hydrate diverter 80. For example a plurality of metal rings may be positioned at different radii within the body of the gas hydrate diverter 80 to impart additional stiffness to the diverter 80. The metal rings may be made of essentially any metal. Furthermore, the reinforcement ring 80 may also contain holes within the body of the reinforcement ring 80 to aid in the fabrication (e.g., mold processing) of the gas hydrate diverter. In one example, a gas hydrate diverter of the present invention may be fabricated using a mold processing technique wherein the reinforcement ring having holes is positioned into a mold having a general shape of the gas hydrate diverter such that melted polymer injected into the mold can flow through the holes of the reinforcement ring during fabrication.

FIG. 6 is a top cross-sectional view of a gas hydrate diverter of the present invention equipped with tubing, according to another embodiment of the invention. As a precautionary measure in the event that a subsea connector becomes frozen to a subsea wellhead, the gas hydrate diverter 80 of the present invention may further include tubing 140 (i.e., plumbing) embedded in the body of the diverter 80 that can be used to circulate fluids that will heat the subsea wellhead, upon which the gas hydrate diverter is installed onto, which in turn will thaw or de-ice the subsea connector. Fluids may be introduced into the tubing 140 via a tubing inlet 150. It should be noted that the tubing 140 may have a wide variety of configurations inside the body of the gas hydrate diverter.

Figure 7:
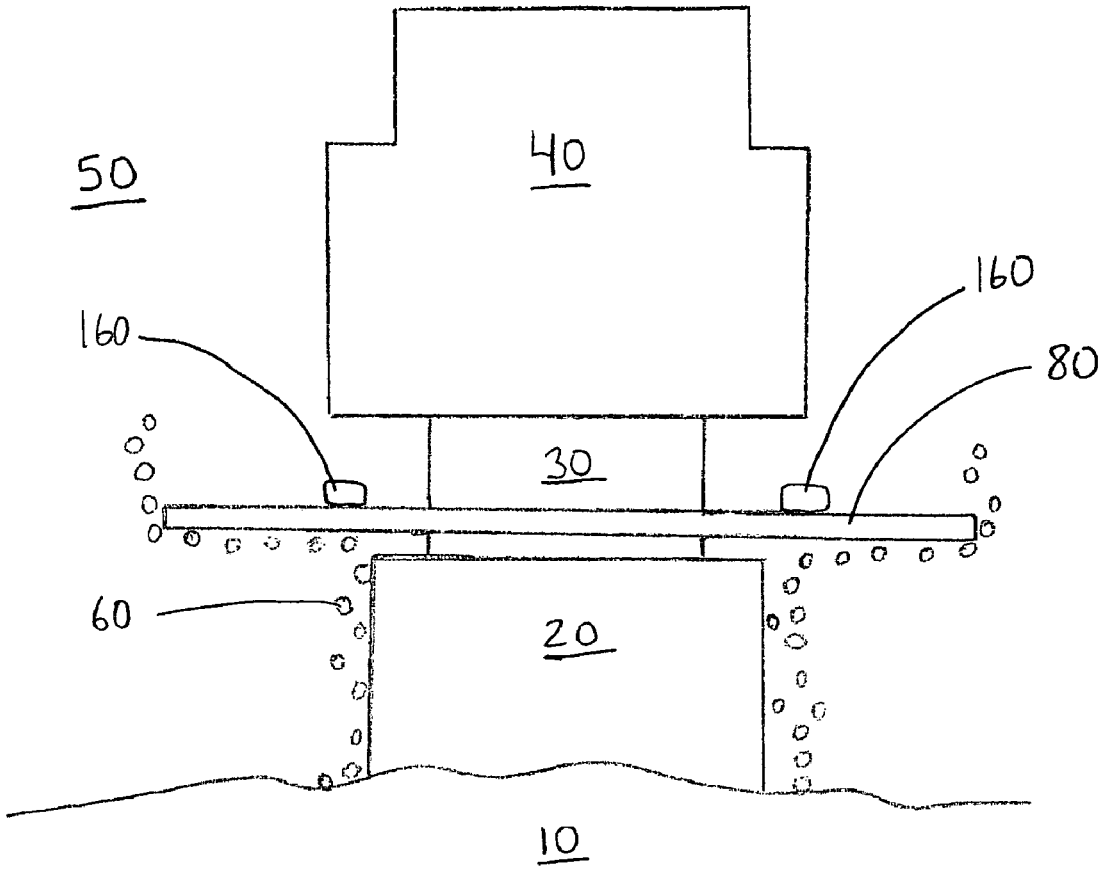
FIG. 7 is a perspective view of a gas hydrate diverter of the present invention having sacrificial anodes, according to another embodiment of the invention.

FIG. 7 is a perspective view of a gas hydrate diverter of the present invention having sacrificial anodes, according to another embodiment of the invention. The body of the gas hydrate diverter 80 of the present invention may be used to attach a sacrificial anode 160 (i.e., soft metal) thereto in order to reduce degradation of the subsea wellhead 30 by electrolysis. A wire (not shown) may connect the anode 160 to the subsea wellhead 30. A wide variety of attaching means may be used to secure the anode to the upper top surface of the gas hydrate diverter 80. Alternatively, the anode 160 may be attached to a lower bottom surface of the gas hydrate diverter 80. Furthermore, more than one sacrificial anode 160 may be attached to a surface of the gas hydrate diverter 80. It is also to be noted that the particular configuration of the sacrificial anode as it is attached to the gas hydrate diverter 80 is not important. The sacrificial anode 80 may be made from materials that should be well known to one of skill in the art.

Figure 8:
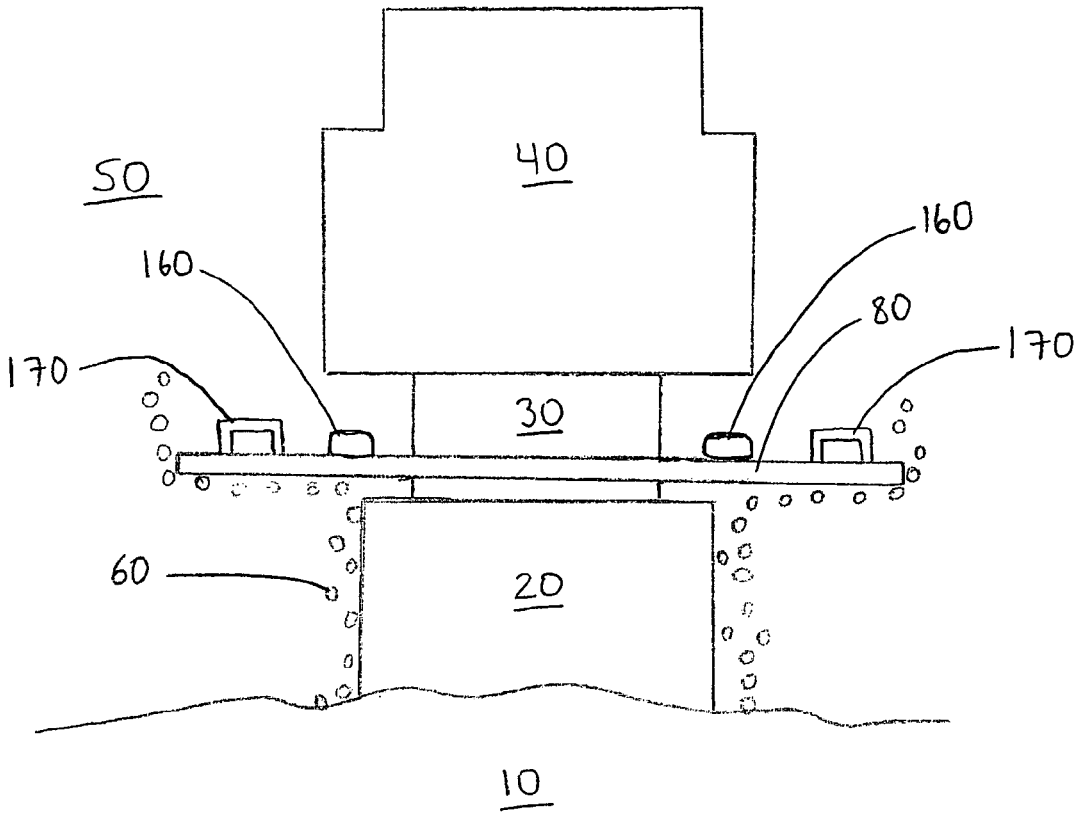
FIG. 8 is a perspective view of a gas hydrate diverter of the present invention having handles, according to another embodiment of the invention.

FIG. 8 is a perspective view of a gas hydrate diverter of the present invention having handles, according to another embodiment of the invention. The body of the gas hydrate diverter 80 of the present invention may preferably have ROV grab handles 170 or attachments that protrude from a surface of the gas hydrate diverter 80. The grab handles 170 are adapted to be grasped by the grasping arm 171 of an ROV 172 in order to install (or remove) the gas hydrate diverter 80 onto the subsea wellhead 30. During installation of the gas hydrate diverter 80, the ROV 172 holds onto the grab handles 170 in order to manipulate the gas hydrate diverter 80 underwater. More specifically, prior to attaching the subsea connector 40 to the subsea wellhead 30, the ROV 172 positions the gas hydrate diverter 80 over the exposed subsea wellhead by aligning the center hole of the diverter over the subsea wellhead. The ROV 172 then lowers the diverter 80 down until the ID of the diverter 80 comes into intimate contact with the outer diameter of the subsea wellhead 30 thereby forming a seal which prevents any leakage of gas hydrates 60 there between. The diverter 80 is also lowered along the outer diameter of the subsea wellhead 30 by the ROV 172 until sufficient room is created that will allow a subsea connector 40 to subsequently lock onto the subsea wellhead 30 from above. The grab handles 170 may also be used by the ROV 172 to remove the gas hydrate diverter 80 from the subsea wellhead 30, if needed. In addition, the grab handles 170 may be permanently attached to the gas hydrate diverter 80 prior to installation over a subsea wellhead, or alternatively the grab handles 170 may be attached to the gas hydrate diverter 80 after the gas hydrate diverter 80 has been installed onto a subsea wellhead.

While the foregoing is directed to embodiments of the present invention, other and further embodiments of the invention may be devised without departing from the basic scope thereof, and the scope thereof is determined by the claims that follow.

What is claimed is:

1. A ROV-deployable gas hydrate diverter for installing on a subsea wellhead, comprising:

a circular disc shaped body with a center hole of sufficient size to fit over the subsea wellhead;

at least one reinforcement ring encapsulated within the body;

means for heating the body when the body is installed on the subsea wellhead, wherein the means for heating the body comprises tubing or plumbing embedded in the body for circulating fluids; and a handle attached to and protruding from a surface of the body, wherein the handle is adapted to be grasped by the grasping arm of an ROV.

2. The ROV-deployable gas hydrate diverter of claim 1, having a weight sufficiently low for an ROV to manipulate and position the gas hydrate diverter onto a subsea wellhead.

3. The ROV-deployable gas hydrate diverter of claim 1 further comprising sacrificial anodes to reduce degradation of the subsea wellhead by electrolysis.

4. The ROV-deployable gas hydrate diverter of claim 3 wherein the sacrificial anode is attached to the upper top surface of the gas hydrate diverter.

5. The ROV-deployable gas hydrate diverter of claim 3 wherein the sacrificial anode is attached to the lower bottom surface of the gas hydrate diverter.

6. The ROV-deployable gas hydrate diverter of claim 1 that is tapered at its inner diameter.

7. The ROV-deployable gas hydrate diverter of claim 1 having a thickness in the range of about 0.5 inches to about 5 inches, an outer diameter in the range of about 40 inches to about 100 inches, and an inner diameter in the range of about 20 inches to about 45 inches.

* * * * *